US006393887B1

(12) United States Patent
Steffens et al.

(10) Patent No.: US 6,393,887 B1
(45) Date of Patent: May 28, 2002

(54) ROLL-HARDENING DEVICE PERTAINING TO A ROLL-HARDENING MACHINE FOR CRANKSHAFTS

(75) Inventors: Hans-Toni Steffens, Erkelenz; Hans Zimmermann, Selfkant, both of (DE)

(73) Assignee: Hegenscheidt-MFD GmbH & Co., KG, Erkelenz (DE)

( * ) Notice: Subject to any disclaimer, the term of this patent is extended or adjusted under 35 U.S.C. 154(b) by 0 days.

(21) Appl. No.: 09/762,171

(22) PCT Filed: Mar. 24, 2000

(86) PCT No.: PCT/EP00/01848

§ 371 (c)(1),
(2), (4) Date: Feb. 2, 2001

(87) PCT Pub. No.: WO00/76724

PCT Pub. Date: Dec. 21, 2000

(30) Foreign Application Priority Data

Jun. 11, 1999 (DE) ..... 299 10 214 U

(51) Int. Cl.[7] ..... B21D 15/00

(52) U.S. Cl. ..... 72/110; 72/107; 72/125; 29/6.01

(58) Field of Search ..... 72/106, 107, 110, 72/125; 29/6.01, 888.08

(56) References Cited

U.S. PATENT DOCUMENTS 3,824,820 A * 7/1974 Jeuken et al. ..... 72/110
5,445,003 A * 8/1995 Gottschalk et al. ..... 72/110
5,943,893 A * 8/1999 Goedderz et al. ..... 72/107
6,161,409 A * 12/2000 Friese ..... 72/110

FOREIGN PATENT DOCUMENTS

DE 197 22 308 C1 4/1998

* cited by examiner

*Primary Examiner*—Ed Tolan
(74) *Attorney, Agent, or Firm*—Proskauer Rose LLP

(57) ABSTRACT

The fixed roll apparatus (8) of a fixed roll machine (1) for crankshafts (3) is constructed scissors-fashion. Two pivotable scissor arms (9 and 10) disposed opposite one another each bear a fixed roll head (13) and a support roll head (14) respectively. The support roll head (14) has two axis-parallel support rolls whose axes of rotation lie in a common plane. The support roll head (14) also has an axial guide roll which is disposed in front of the support rolls in the pivoting direction (35) for closure and whose axis of rotation is perpendicular to the axis of rotation of the crankshaft (3) and lies in a plane which forms an acute angle with the common plane of the axis of rotation of the support rolls, its diameter being larger than the width of the support roll head (14) and slightly smaller than the spacing of the adjacent oil collars of a main bearing pin or a connecting rod bearing pin.

4 Claims, 5 Drawing Sheets

ROLL-HARDENING DEVICE PERTAINING TO A ROLL-HARDENING MACHINE FOR CRANKSHAFTS

Figure 1:
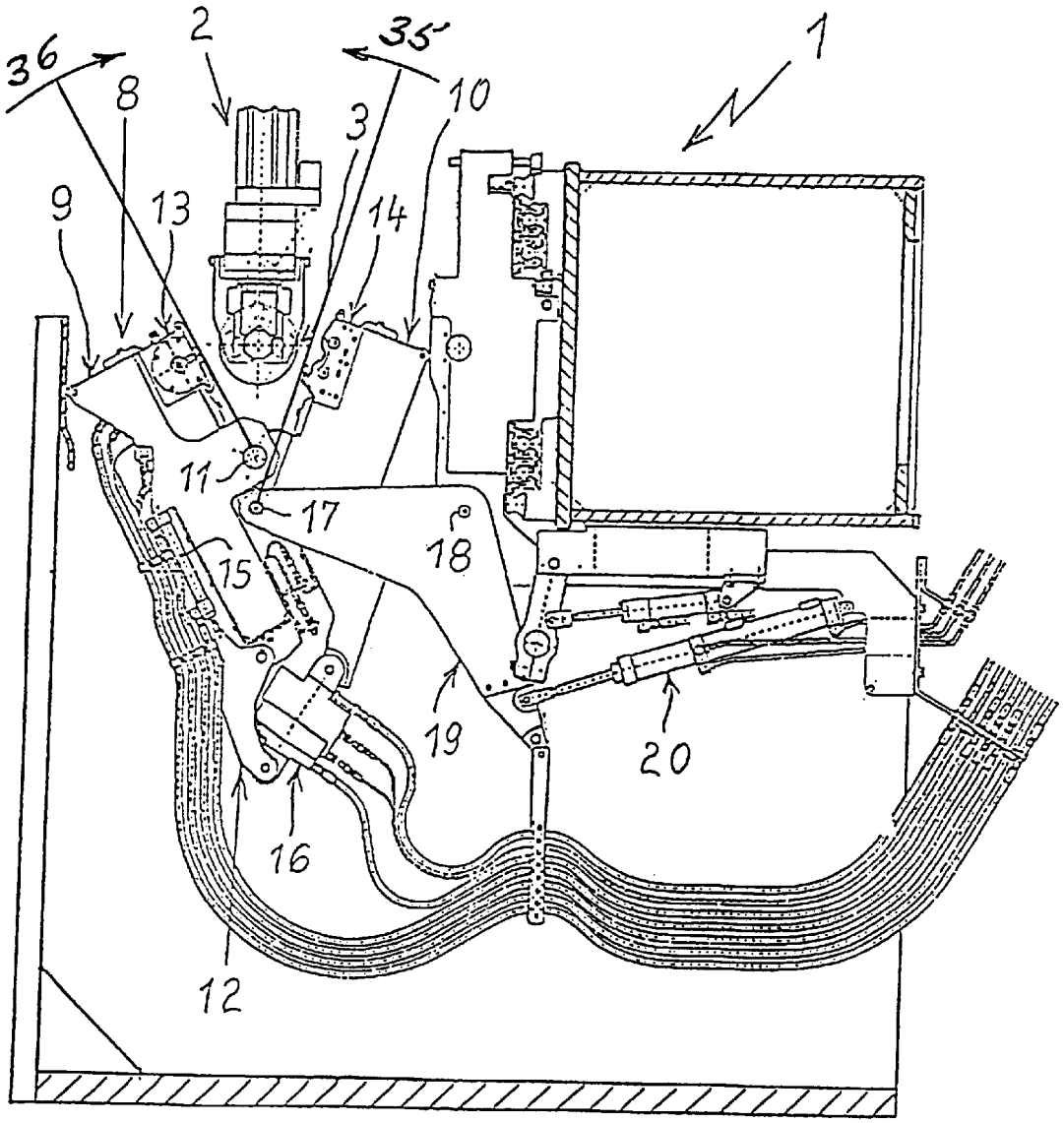

This application is a 35 USC 371 of PCT/EP00/01848 filed Mar. 24, 2000.

The invention relates to a fixed roll apparatus of a fixed roll machine for crankshafts which is of scissors construction and wherein two pivotable scissors arms disposed opposite one another bear a fixed roll head and a support roll head respectively, the support roll head having two axis-parallel support rolls whose axes lie in a common plane with a drive device which generates the closure and opening movement of the fixed roll apparatus and also generates the fixed roll force.

Fixed roll apparatuses of the kind specified are known from German Patent Specification DE 197 22 308 C1, which discloses a fixed roll machine for crankshafts.

In such a fixed roll machine a fixed roll apparatus can be associated with each main bearing pin and connecting rod bearing pin of a crankshaft.

The construction of the fixed roll machine is such that during the closure of each fixed roll apparatus, first the support rolls of the support roll head and then the fixed rolls of the fixed roll head are forced against a main bearing pin or a connecting rod bearing pin, the support roll head and the fixed roll head each performing a pivoting movement in succession.

The pivoting movement of the support roll and fixed roll heads in the closure direction involves the risk that the support roll and fixed roll heads may collide with the crankshaft in the zone of an oil collar, since there is only a small free space between the support roll and fixed roll heads on the one hand and the two oil collars of a main bearing pin or a connecting rod bearing pin on the other.

It is an object of the invention so to construct a fixed roll apparatus of the kind specified that the pivoting movement of the support roll and fixed roll heads in the closure direction cannot cause any collision with the crankshaft in the zone of an oil collar.

This problem is solved according to the invention by the features that the support roll head has at least one axial guide roll which is disposed in front of the support rolls in the pivoting direction for the closure of the scissors arm bearing the support rolls, whose axis of rotation is perpendicular to the axis of rotation of the crankshaft and lies in a plane which encloses an acute angle with the plane of the axes of rotation of the support rolls, and whose diameter is larger than the width of the support roll head and slightly smaller than the spacing of the oil collars of a main bearing pin or a connecting rod bearing pin.

The invention ensures that if during the closure operation of the fixed roll apparatus the guide roll knocks against an oil collar, the fixed roll apparatus is straightened in the axial direction of the crankshaft.

Such an alignment of the fixed roll apparatus ensures that even during the pivoting movement of the fixed roller head in the closure direction no collision can take place between the fixed roll head and the crankshaft in the zone of an oil collar.

In case the acute angle between the plane containing the axis of rotation of the axial guide roll and the common plane formed by the axes of rotation of the two support rolls falls to zero, the axial guide roll has a spacing from said common plane. The external contour of the axial guide roll can also have not only the conventional cylindrical shape, but other shapes being, for example, crowned or made up of a number of geometrical shapes.

For processing particularly wide shaft bearing pins it is possible to use not only one but several axial guide rollers which are disposed one beside the other and fill the free space circumscribed by two adjacent oil collars. Usually these are two axial guide rolls whose external width is such that the two axial guide rolls fit into the free space between the oil collars with a small lateral clearance. Such an arrangement also has the advantage that the axial guide rolls are relatively small. As a result, at the same time the lateral friction between the axial guide rollers and the oil collars is reduced.

Figure 2:
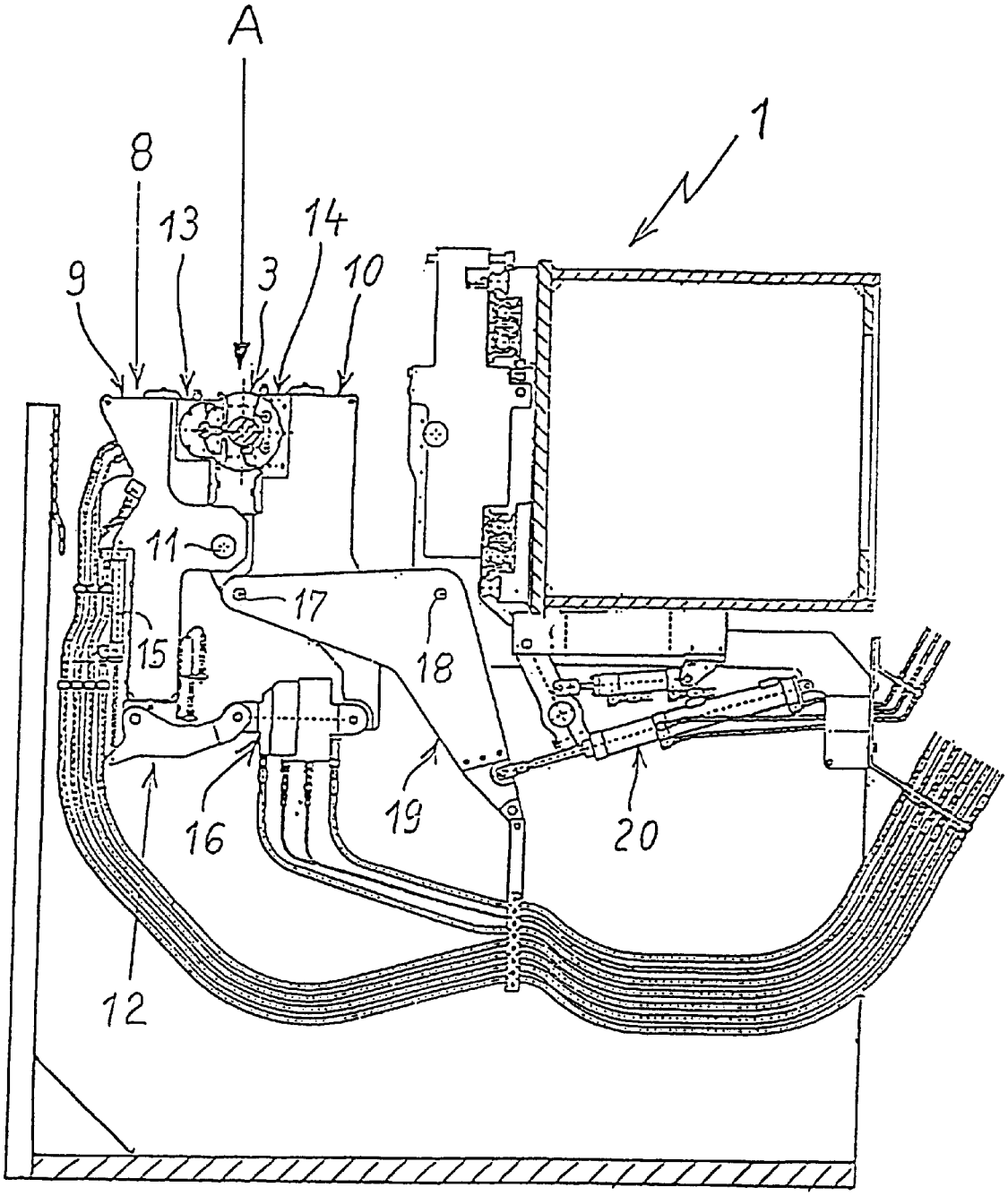
Figure 3:
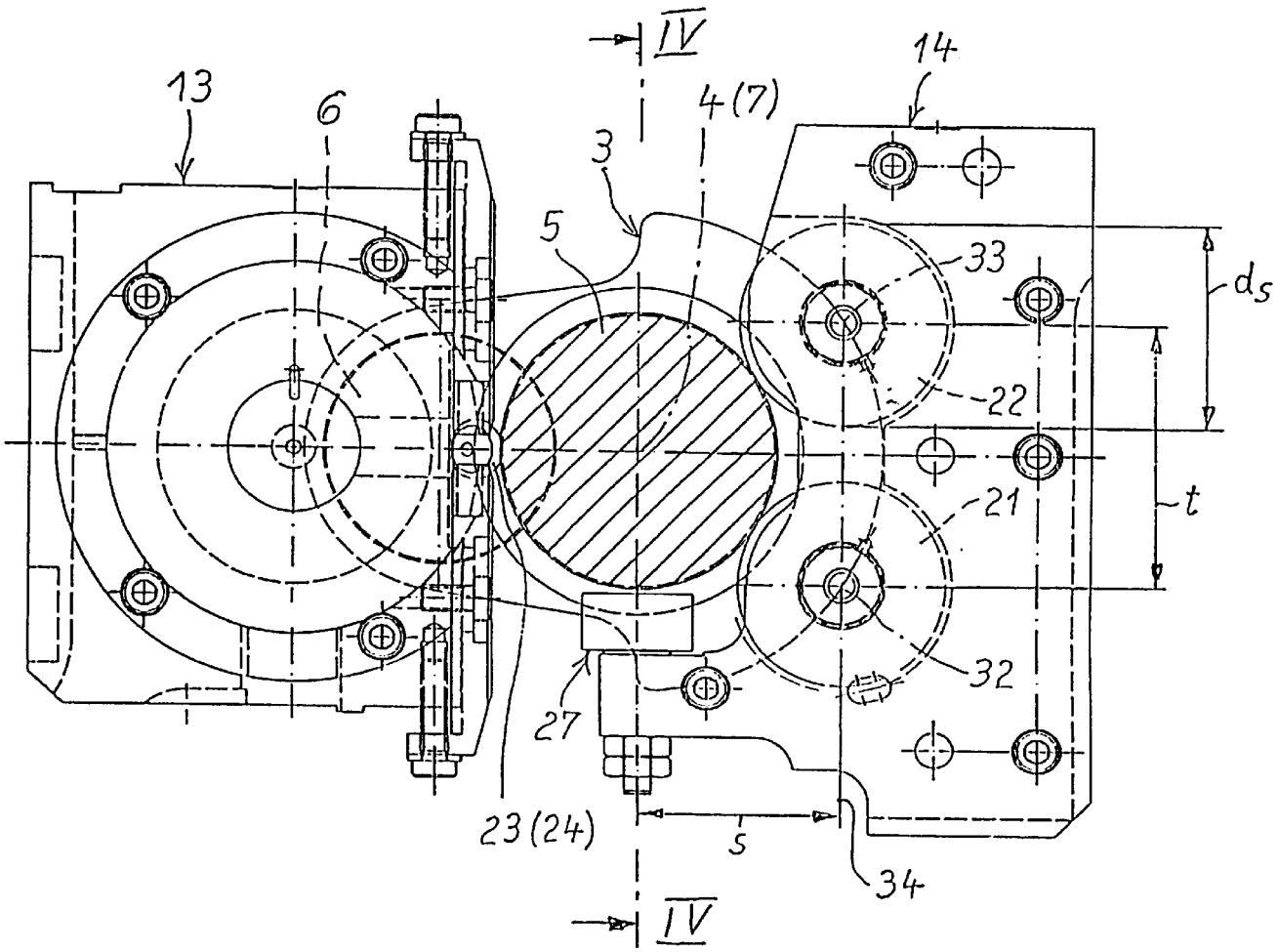
Figure 4:
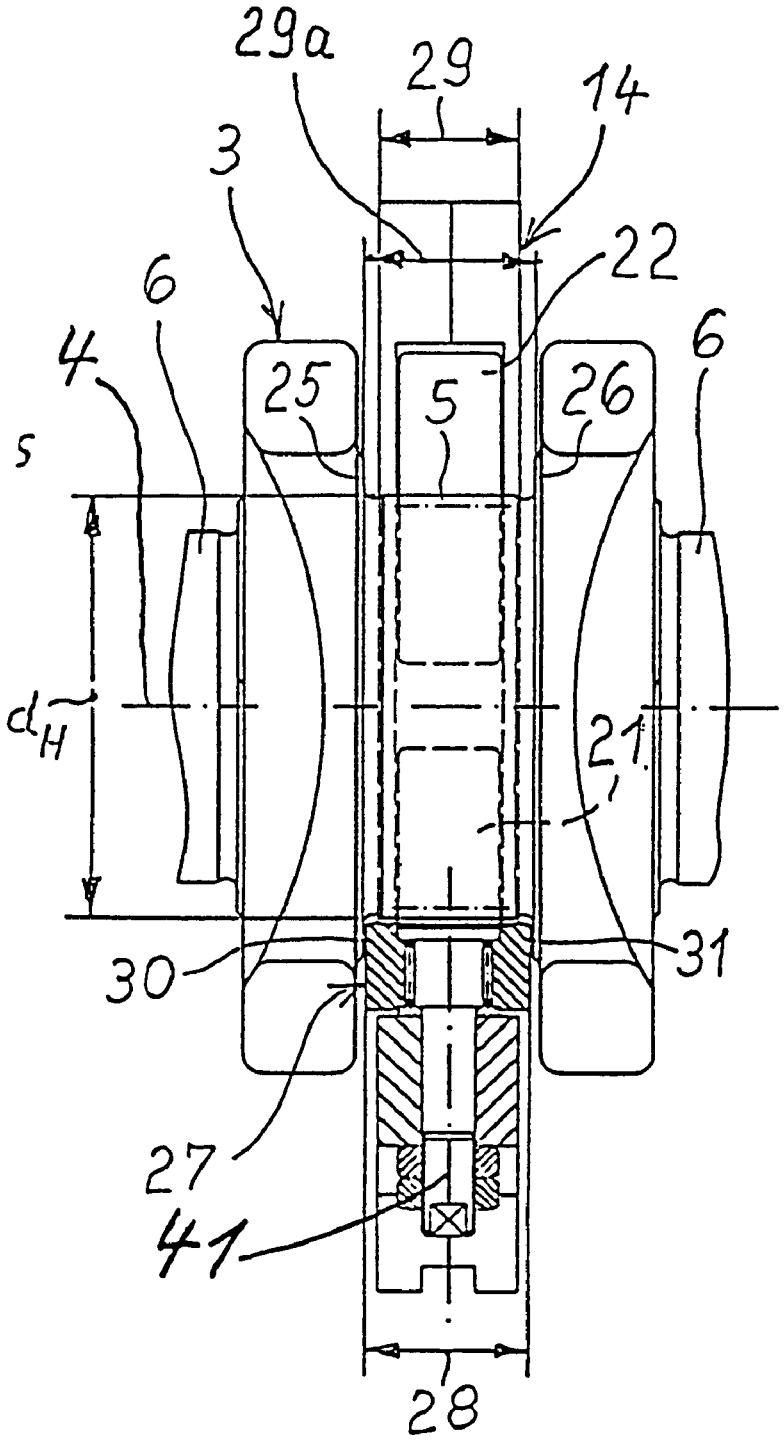
Figure 5:
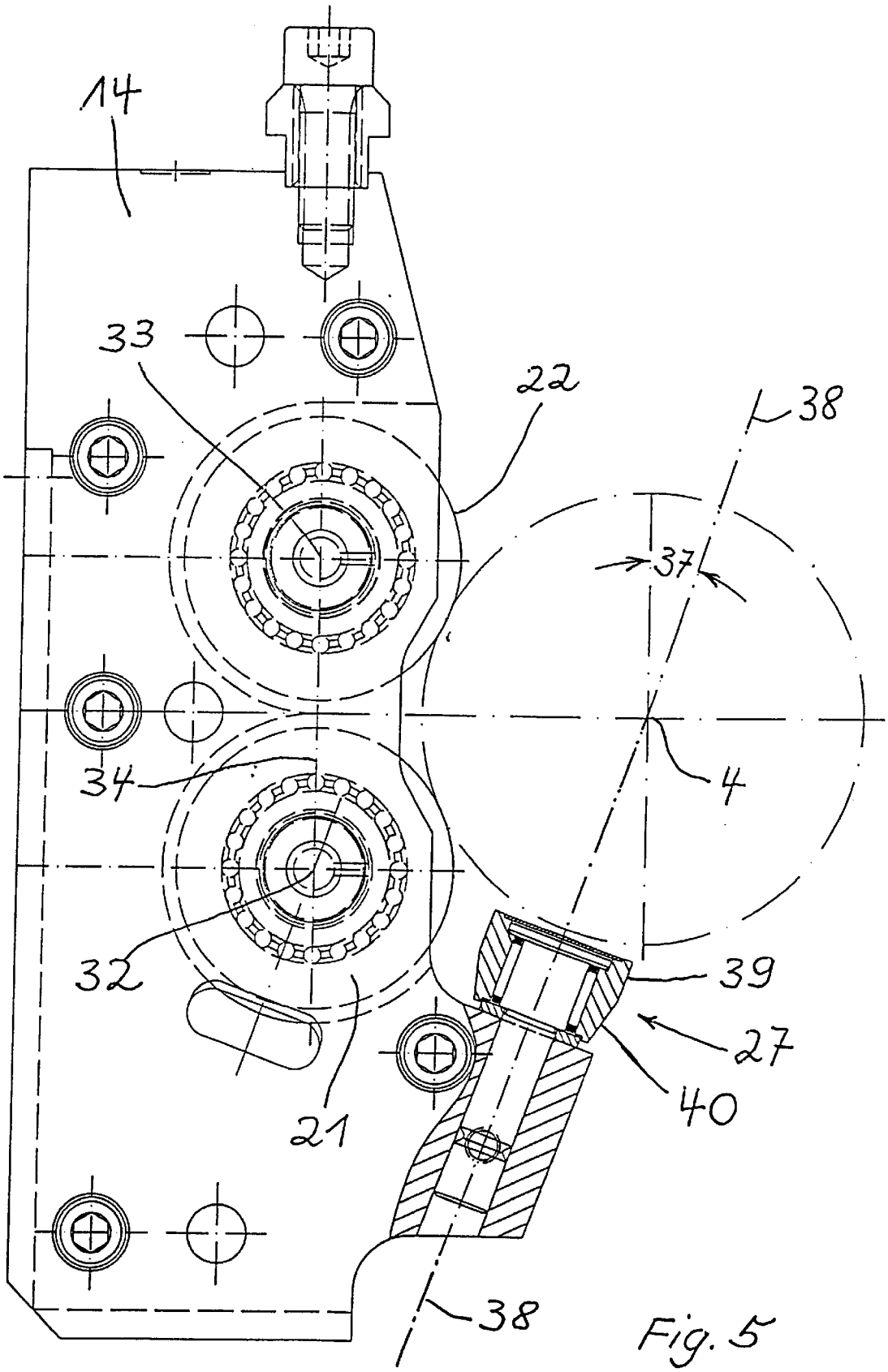

The invention will now be described in greater detail with reference to drawings which diagrammatically illustrate embodiments thereof and which show:

FIG. 1 a section through a fixed roll machine with a partial view of a crankshaft conveying device, wherein a fixed roll apparatus occupies its opening position in relation to an introduced crankshaft, FIG. 2 the section through the fixed roll machine and a section through a main bearing pin of the crankshaft, the fixed roll apparatus being in its closure position, FIG. 3 a detail A from FIG. 2 to an enlarged scale, FIG. 4 a section taken along the line IV—IV in FIG. 3, and FIG. 5 a section similar to FIG. 3 with a special arrangement of the axial support roll.

A fixed roll machine 1 has a driving device (not shown) for the reception of a crankshaft 3 introduced by a crankshaft conveying device 2.

The driving device generates the rotary movement of the crankshaft 3 around its axis 4 during the fixed rolling of a main bearing pin 5 and a connecting rod bearing pin 6. The axis 4 therefore lies in the axis of rotation 7 of the driving device.

However, the embodiment shown is limited to the fixed roll of a main bearing pin 5 of the crankshaft 3, since this is sufficient to explain the subject matter of the invention.

Associated with the main bearing pin 5 is a fixed roll apparatus 8 of scissors construction and having two scissors arms 9, 10, a scissors pivot 11, a driving device 12, a fixed roll head 13 and a support roll head 14. Due to the scissors construction, the fixed roll head 13 and the support roll head 14 cannot move individually in the direction along the axis of rotation 4, but they can be adjusted only in certain planes corresponding to the particular position of the main bearing pin 5/connecting rod bearing pin to be processed along the axis of rotation 4 of the crankshaft 3. Such a plane is shown by way of example in FIG. 3.

The driving device 12 has an adjusting cylinder 15 and a force apparatus 16.

The adjusting cylinder 15 generates the closure and opening movement of the aforedescribed scissors of the fixed roll apparatus 8; the force apparatus 16 generates the fixed roll force. A particularly narrow construction of the fixed roll apparatus 8 is achieved by the subdivision of the movements generated by the cylinders 15 and 16.

The fixed roll apparatus 8 is articulated via a point of articulation 17 to a toggle lever 19 pivotable around an axis 18.

The toggle lever 19 can be pivoted by means of a piston-and-cylinder unit 20. The fixed roll apparatus 8 is moved into and out of the operating position by the actuation of the piston-and-cylinder unit 20.

The fixed roll machine 1 is so designed that during the closure of the fixed roll apparatus 8 first the two axis-parallel support rolls 21, 22 of the support roll head 14 and then the two fixed rolls 23, 24 of the fixed roll head 13 come to bear against the main bearing pin 5.

As viewed in FIG. 1, the support roll head 14 makes an anti-clockwise pivoting movement 35 around the point of articulation 17, the fixed roll head 13 making a clockwise pivoting movement 37 around the scissors pivot 11. The two pivoting movements 35 and 36 are performed simultaneously and when each is completed the closure position is reached, as shown in FIG. 2. The closure position corresponds to the operating position of the fixed roll apparatus 8. During the pivoting movements 35; 36 of the support roll head 14 and the fixed roll head 13 in the closure direction, any collision with one of the two oil collars 25, 26 of the main bearing pin 5 is prevented by an axial guide roll 27. The axial guide roll 27 is disposed at an acute angle 37 between 0 and 45° and in a plane 38. The pivoting axis 41 around which the axial guide roll 27 can be rotated lies in a plane 38 and is perpendicular to the axis of rotation 4 of the crankshaft 3 (FIG. 4).

Geometrically viewed, the plane 38 also encloses the axis of rotation 4 of the crankshaft 3—i.e., the plane 38 can rock around the axis of rotation 4. A comparison of FIGS. 3 and 5 clearly indicates this possibility. For example, as viewed in FIG. 3, the plane 38 falls in the sectional plane IV—IV—i.e., the acute angle 37 is zero and the axial guide roller 27 has a lateral spacing s from the plane 34 in which the two axes 32 and 33 lie. In this special case the two planes 34 and 38 extend parallel with one another.

In contrast, as shown in FIG. 5 the axial guide roll 27 is inclined at an acute angle 37 greater than zero in relation to the common plane 34 of the two axes 32 and 33 of the particular support rolls 21 and 22. As a result of this construction, when the support roll head 14 is pivoted into the closure position in the direction of the pivoting movement 35, the axial guide roller 27 leads on the two support rolls 21 and 22. In front of the support rolls 21 and 22 the axial guide roll 25 enters the free space which is circumscribed by the spacing 29*a* of the two oil collars 25 and 26 on the main bearing pin. In this way when the fixed roll apparatus 8 is closed, neither of the support rolls 21 or 22 knocks against one of the oil collars 25 or 26.

The axial guide roll 27 can have different shapes. For example, as shown in FIG. 3 it has a cylindrical shape. As shown in FIG. 5 the axial guide roll 27 has a multiple contour which is made up of a cylindrical portion 39 and a conical portion 40. The axial guide roll 27 can also be constructed crowned (not shown). In the case of bearing pins 5 which have a particularly width 29*a*, two axial guide rolls (not shown) disposed one beside the other can be substituted for a single axial guide roll 27, one guide roll bearing against the oil collar 25 and the second against the oil collar 26.

Due to the scissors construction of the fixed roll apparatus 8, the axial guide roll 27 at the same time also guides the fixed roll head 13 in the axial direction.

The diameter 28 of the axial guide roll 27 is larger than the width 29 of the support roll head and slightly smaller than the spacing 29*a* of the oil collars 25, 26 of the main bearing pin 5.

In the closure position of the securing roll apparatus 8 (FIG. 2), for the two free spaces 30, 31 a clearance of approximately 0.25 mm is provided on each side between the oil collars 25, 26 and the guide roll 27.

LIST OF REFERENCES

1 fixed roll machine
2 crankshaft conveying device
3 crankshaft
4 axis of rotation of the crankshaft
5 main bearing pin
6 connecting rod bearing pin
7 axis of rotation of the driving device
8 fixed roll apparatus
9 scissors arm
10 scissors arm
11 scissors pivot
12 driving device
13 fixed roll head
14 support roll head
15 adjusting cylinder
16 force apparatus
17 point of articulation
18 axis
19 toggle lever
20 piston-and-cylinder unit
21 support roll
22 support roll
23 fixed roll
24 fixed roll
25 oil collar
26 oil collar
27 axial guide roll
28 diameter of the axial guide roll
29 width of the support roll head
29*a* spacing of the oil collars
30 free space
31 free space
32 axis of the support roll
33 axis of the support roll
34 plane through the axis
35 pivoting movement
36 pivoting movement
37 angle
38 plane
39 cylindrical portion
40 conical portion
41 axis of rotation

What is claimed is:

1. A fixed roll apparatus of a fixed roll machine for crankshafts which is of scissors construction and wherein two pivotable scissors arms disposed opposite one another bear a fixed roll head and a support roll head respectively, the support roll head having two axis-parallel support rolls whose axes of rotation lie in a common plane with a driving device generating the closure and opening movement of the fixed roll apparatus and also generating the fixed roll force, characterised in that the support roll head (14) has at least one axial guide roll (27) which is disposed in front of the support rolls (21 and 22) in the pivoting direction (35) for the closure of the scissors arm (10) bearing the support rolls (21 and 22), whose axis of rotation (41) is perpendicular to the axis of rotation (4) of the crankshaft (3) and lies in a plane (38) which encloses an acute angle (37) with the plane (34) of the axes of rotation (22 and 33) of the support rolls (21 and 22), and whose diameter (28) is larger than the width (29) of the support roll head (14) and slightly smaller than the spacing (29*a*) of the oil collars (25, 26) of a main bearing pin (5) or a connecting rod bearing pin (6).

2. A fixed roll apparatus according to claim 1, characterised in that the acute angle (37) is 0° and the axis of rotation (41) of the axial guide roll (27) has a spacing (s) from the plane (34).

3. A fixed roll apparatus according to claim 1, characterised in that the guide roll (27) has a contour which is cylindrical and crowned or is made up of different geometrical portions (39, 40).

4. A fixed roll apparatus according to claim 1, characterised in that associated with each of two support rolls (21, 22) are a number of axial guide rolls (27) whose diameter is smaller than the width (29) of the support roll head (14) and whose external width is slightly smaller than the spacing (29*a*) of the oil collars (25, 26) of a main bearing pin (5) or a connecting rod bearing pin (6).

* * * * *